US005890600A

United States Patent [19]

Laatikainen

[11] Patent Number: 5,890,600

[45] Date of Patent: Apr. 6, 1999

[54] METHOD AND APPARATUS FOR REMOVING IMPURITIES FROM PULVERIZED OR CHIPPED MATERIAL, ESPECIALLY WOOD CHIP AND FIBER MATERIALS

[75] Inventor: Aarne Laatikainen, Valko, Finland

[73] Assignee: Sunds Defibrator Loviisa Oy, Valko, Finland

[21] Appl. No.: 601,088

[22] Filed: Feb. 14, 1996

[30] Foreign Application Priority Data

Feb. 15, 1995 [FI] Finland ..... 950680

[51] Int. Cl.[6] ..... B07B 13/05

[52] U.S. Cl. ..... 209/44; 209/673

[58] Field of Search ..... 209/659, 660, 209/673, 667, 668, 479, 44

[56] References Cited

U.S. PATENT DOCUMENTS

| | | | |
|---|---|---|---|
| 4,102,502 | 7/1978 | Vaplon et al. | 209/673 X |
| 5,058,751 | 10/1991 | Artiano | 209/673 |
| 5,386,914 | 2/1995 | Eramaja et al. | 209/673 |

FOREIGN PATENT DOCUMENTS

| | | | |
|---|---|---|---|
| 922777 | 6/1992 | Finland . | |
| 93806 | 6/1995 | Finland . | |
| 1143762 | 12/1959 | Germany | 209/479 |
| 1729615 | 4/1992 | U.S.S.R. | 209/673 |

OTHER PUBLICATIONS

Publication "Classifarmer for surface" from Sunds Defibrator. Year 1994.

*Primary Examiner*—Tuan N. Nguyen
*Attorney, Agent, or Firm*—Flehr Hohbach Test Albritton & Herbert

[57] ABSTRACT

The invention relates to a method and apparatus for screening pulverized or chip material, such as fibers or wood chips, free from impurities. The material to be screened is fed onto a roll set formed by a number of adjacent, essentially parallel rolls (1) and is brought to an advantageous movement with the help of the rolls (1), whereby material particles of highest density drift downward closest to the surfaces of the rolls and that the material fraction closest to the roll surfaces can escape the rolls via a gap (B) a width essentially larger than the gap width (A) of the preceding roll pairs.

6 Claims, 1 Drawing Sheet

METHOD AND APPARATUS FOR REMOVING IMPURITIES FROM PULVERIZED OR CHIPPED MATERIAL, ESPECIALLY WOOD CHIP AND FIBER MATERIALS

FIELD OF THE INVENTION

The present invention relates to a method according to the preamble of claim 1. The invention also concerns an apparatus according to the preamble of claim 5.

BACKGROUND OF THE INVENTION

Pulverized and chipped materials comprise, e.g., different kinds of fibers and wood chips used in the manufacture of particleboard/fiberboard and similar products. Such boards are made increasingly from residue materials. Resultingly, a need arises for removing impurities from the raw material stock. Typical impurities comprise different minerals, rocks, sand and similar particulates. In the board manufacturing process, the content of impurities significantly affects the wear rate of tools such as different cutting means employed in the finishing operations of boards made from residue materials. Hence, a variety of screening methods has been developed. Known in the art are arrangements in which mere blowing by air is used for separating impurities from the raw material. Such embodiments are handicapped by high specific energy consumption and dust emissions. Moreover, extremely fine impurity particulates are not removed in a desired manner by air blowing, whereby the end result of the screening operation remains unsatisfactory.

It is an object of the present invention to provide an entirely novel method and apparatus for removing impurities from pulverized or chip material, said method and apparatus being free from the disadvantages of conventional techniques.

SUMMARY OF THE INVENTION

The invention is characterized in what is stated in the annexed claims.

The arrangement according to the invention offers a number of significant benefits. Mechanical screening of impurities offers an essential reduction in specific energy consumption with regard to separation with air blowing alone. The screening apparatus will become smaller and easy to combine with a roll set screen, for instance. Furthermore, the material fractions precleaned or fractionated with the help of the method according to the invention can be easier and more effectively handled in further processing by means of, e.g., other post-screening apparatuses.

By arranging the screen roll set to have the narrower slits between the rolls at the intake end of the apparatus, it will be possible to screen away fines such as silt that are otherwise extremely difficult or even impossible to remove by pneumatic means, for instance.

BRIEF DESCRIPTION OF THE DRAWINGS

In the following the invention will be examined with the help of a preferred exemplifying embodiment by making reference to the appended drawing FIG. 1, in which the screening process by means of the screen roll set according to the invention is illustrated diagrammatically.

BEST MODE FOR CARRYING OUT THE INVENTION

Figure 1:
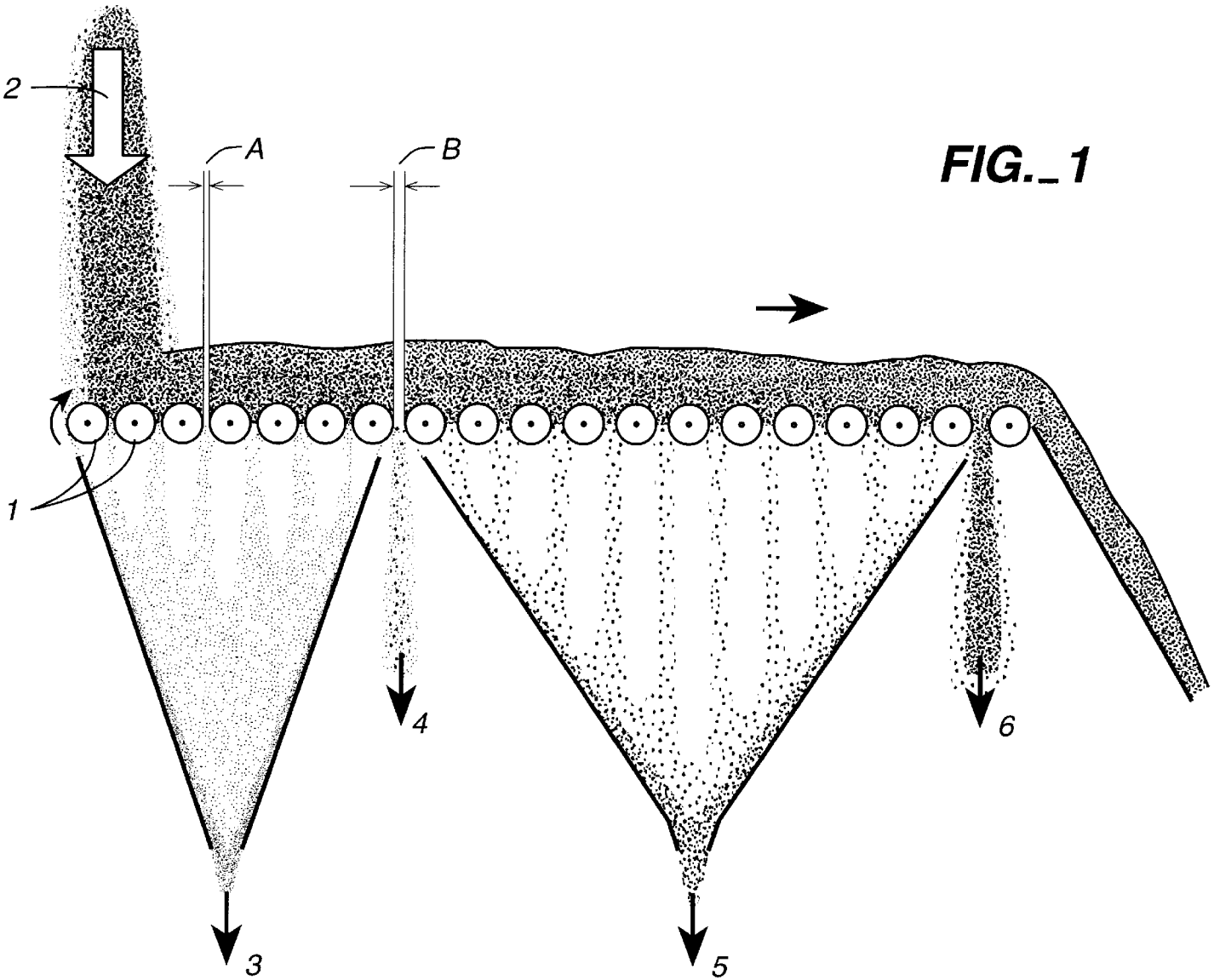

The screening method according to the invention is based on the use of a roll set. The material to be screened is taken and fed by means of conventional feed elements (not shown) onto the roll set, at its intake end, advantageously spread in the cross-machine direction relative to the travel direction of the chips essentially over the entire width of the roll set. The roll set is formed by a plurality of adjacent, essentially parallel rolls 1, which are arranged to rotate clockwise (arrow) when viewed at the roll ends as shown in the diagram. The rolls are spaced from each other to provide gaps, preferably with individually adjustable widths, for each pair of adjacent rolls. A feasible adjustment method is disclosed in FI patent application no. 922,777. While the rolls are advantageously aligned in the same plane, other arrangements are also possible. For instance, the rolls can be stepped at increasing heights toward the exit end of the material.

Typically, the width A of the interroll gap at the intake end of the roll set is 0.2–0.5 mm. These leading rolls are followed by a gap having a width B essentially wider than the gap width A of the leading rolls. Typically, the gap width B is in the order of 1–2.5 mm. The width of the interroll gaps as well as their mutual staging are parameters that are obviously dependent on the material being screened. The rolls 1 may be provided with a surface texturing such as different kinds of grooves, for instance. The depth of such texturing may be varied, e.g., typically so that the grooves on the exit end rolls are deeper than in the intake end rolls.

Onto the intake end of the roll set is fed in the manner indicated by arrow 2 such raw material, e.g., residues that contain fibers and mixed therein impurities like minerals, e.g., sand and rocks. The rotating rolls 1 then transfer the material forward on the rolls and impart the material blanket resting on the rolls to undergo an advantageous movement such as an almost fluidized-bed state, whereby the material particulates of highest density drift downward closest to roll surfaces. Only the finest particulates 3 can pass through the interroll gaps A of the roll set 1. The fraction of fines 3 passing through the gaps A will be enriched with the fine particulates accumulated close to the surfaces of the rolls. The other fractions of the material including coarser impurities running closest to the surfaces of the rolls will be moved forward along the roll set. As the material blanket reaches the next wider gap B, the next fraction of impurities 4 closest to the rolls can here escape the rolls by passing through the gap B. Simultaneously, the major fraction is transferred over the gap B. Now, the major fraction of the material to be screened is cleaned free from impurities. Such clean material fraction can be transferred to further processing. The roll set may comprise a plurality of gaps, each wider than the preceding gap to perform in the above-described manner, whereby the screening process is iteratively repeated at each gap.

In the apparatus shown in the diagram, the first roll set is followed by a second roll set in which the particulate matter is screened via the interroll gaps into material fractions indicated by arrow 5, while the impurities indicated by arrow 6 are screened away through the exit end gap and removed in same manner as described above for the roll set of wider roll gaps.

Means such as chutes are advantageously arranged under the rolls for taking the screened material fractions to further processing.

The method according to the invention may be easily adapted and the assembly according to the invention readily connected to existing roll set screen equipment. The invention finds important use in chipboard manufacture when combined with, e.g., the screening step following the drying step of chips.

To those versed in the art it obvious that the invention is not limited by the exemplifying embodiments described above, but rather, may be varied within the scope and spirit of the annexed claims.

I claim:

1. A method of screening pulverized or chip material, free from impurities, characterized in that the material to be screened is fed onto a roll set formed by a plurality of adjacent, essentially parallel rolls (1) forming an initial enrichment section of rollers with gas widths (A) followed by at least one gap (B) of greater width and is brought to a fluid movement of material with the help of said rolls (1) in a manner whereby material particles of highest density drift downward closest to the surfaces of the rolls of gap width (A) and lowest density particles are carried above and by the highest density particles and whereby the highest density material fraction closest to the roll surfaces with the impurities enriched therein can escape the rolls via a gap (B), which has a larger width than the gap width (A) of the preceding roll pairs, and the lower density particles move over gap (B).

2. A method as defined in claim 1, characterized in that a major portion of the screened material is passed via said gap (B) to further processing by, e.g., screening or postcleaning.

3. A method as defined in claim 1 or 2, characterized in that fine particulates (3) with fine impurities enriched thereto are removed via said gap width (A).

4. A method as defined in claim 1, characterized in that the material fraction removed from the roll set via said gaps (A) or said gap (B) is taken to further processing.

5. The method of claim 1 wherein, the pulverized or chip material includes fibers or wood chips.

6. The method of claim 4 wherein the step of further processing includes additional fractionation.

* * * * *